US011056305B2

(12) United States Patent
Huang et al.

(10) Patent No.: US 11,056,305 B2
(45) Date of Patent: Jul. 6, 2021

(54) RELAY

(71) Applicant: BYD COMPANY LIMITED, Guangdong (CN)

(72) Inventors: Caili Huang, Shenzhen (CN); Baotong Yao, Shenzhen (CN); Lujian Wang, Shenzhen (CN); Siyuan Liu, Shenzhen (CN)

(73) Assignee: BYD Company Limited, Guangdong (CN)

( * ) Notice: Subject to any disclaimer, the term of this patent is extended or adjusted under 35 U.S.C. 154(b) by 430 days.

(21) Appl. No.: 16/303,621

(22) PCT Filed: May 3, 2017

(86) PCT No.: PCT/CN2017/082905
§ 371 (c)(1),
(2) Date: Nov. 20, 2018

(87) PCT Pub. No.: WO2017/206653
PCT Pub. Date: Dec. 7, 2017

(65) Prior Publication Data

US 2020/0321178 A1 Oct. 8, 2020

(30) Foreign Application Priority Data

May 31, 2016 (CN) ..... 201610379158.3

(51) Int. Cl.
*H01H 67/02* (2006.01)
*H01H 50/02* (2006.01)
(Continued)

(52) U.S. Cl.
CPC ..... *H01H 50/021* (2013.01); *H01H 9/10* (2013.01); *H01H 50/023* (2013.01);
(Continued)

(58) Field of Classification Search
CPC ..... H01H 9/10; H01H 50/54
(Continued)

(56) References Cited

U.S. PATENT DOCUMENTS 7,659,801 B2 * 2/2010 Kusumoto ..... F02N 15/067 335/126
10,490,380 B2 * 11/2019 Yao ..... H01H 85/08
(Continued)

FOREIGN PATENT DOCUMENTS

| | | | |
|---|---|---|---|
| CN | 204927190 | U | 12/2015 |
| JP | 2002324478 | A | 11/2002 |
| JP | 2005005243 | A | 1/2005 |

OTHER PUBLICATIONS

English Translation of International Search Report and Written Opinion from PCT/CN2017/082905 dated Aug. 8, 2017 (9 pages).

*Primary Examiner* — Alexander Talpalatski
(74) *Attorney, Agent, or Firm* — Calfee Halter & Griswold LLP

(57) ABSTRACT

A relay includes: a housing, a base plate, and a driving device, connected to the base. At least one stationary contact group is provided on the housing. The stationary contact group includes two stationary contacts insulated from each other. At least one stationary contact in the stationary contact group includes an upper terminal and a lower contact are included. The upper terminal and the lower contact are isolated from each other and electrically connected by a fuse. The base plate is provided in the housing and can switch between on and off positions. The base plate, when being in the on position, contacts the stationary contact group for the electrical conduction of the two stationary contacts in the stationary contact group, and, when being in the off position, is isolated from the stationary contact group
(Continued)

for disconnecting the electrical conduction of the two stationary contacts in the stationary contact group.

20 Claims, 5 Drawing Sheets

(51) Int. Cl.
*H01H 9/10* (2006.01)
*H01H 50/14* (2006.01)
*H01H 50/54* (2006.01)
*H01H 85/02* (2006.01)

(52) U.S. Cl.
CPC ..... *H01H 50/14* (2013.01); *H01H 50/54* (2013.01); *H01H 85/0241* (2013.01); *H01H 2050/025* (2013.01)

(58) Field of Classification Search
USPC ..... 335/126, 131
See application file for complete search history.

(56) References Cited

U.S. PATENT DOCUMENTS

2004/0012902 A1* 1/2004 Ikeda ..... F02N 11/087 361/23
2013/0301974 A1 11/2013 Yamada et al.

* cited by examiner

RELAY

CROSS-REFERENCE TO RELATED APPLICATIONS

The present application is a 371 application of International Application No. PCT/CN2017/082905, filed on May 3, 2017, which claims priority of Chinese Patent Application No. 201610379158.3 filed in China on May 31, 2016, the entire contents of which are hereby incorporated by reference.

TECHNICAL FIELD

The present disclosure relates to a field of electrical equipment, and in particular, to a relay.

BACKGROUND

A short circuit may occur during the use of electrical equipment. In the related art, the relay has no overload protection device. When the relay is turned on, once a load current is too large or a short circuit occurs in a circuit, it is easy to cause a fire, which causes the product to lose functions and causes a risk. In addition, the above relay has no arc-extinguishing device, which resulting in long arcing time and short product lifetime.

SUMMARY

In order to solve one of the technical problems in the related art. The one object of the present disclosure is to provide a relay for reducing or avoiding a safety hazard due to current overload or short circuit.

A relay according to an embodiment of the present disclosure, comprising: a housing, on which at least one stationary contact group is provided, wherein the stationary contact group includes two stationary contacts insulated from each other, at least one stationary contact in the stationary contact group includes an upper terminal and a lower contact are included, and the upper terminal and the lower contact are isolated from each other and electrically connected by a fuse; a base plate, which is provided in the housing and can switch between an on position and an off position, wherein the base plate, when being in the on position, contacts the stationary contact group for the electrical conduction of the two stationary contacts in the stationary contact group, and the base plate, when being in the off position, is isolated from the stationary contact group for disconnecting the electrical conduction of the two stationary contacts in the stationary contact group; and a driving device, connected to the base plate so as to drive the base plate to switch between the on position and the off position.

In the above, the base plate being in the on position means that the base plate being in the conductive position; and the base plate being in the off position means that the base plate is being in the disconnected position.

In the relay according to the embodiment of the present disclosure, the fuse has the effects of overload protection and short circuit protection to enhance the safety of a circuit system having the relay and avoid a fire disaster or the like due to the over-current or short circuit.

In addition, the relay according to the embodiment of the present disclosure may further have the following additional technical features:

In some embodiments of the present disclosure, an insulating ring is connected between the upper terminal and the lower contact, wherein the upper terminal encloses the upper end of the insulating ring and the lower contact encloses the lower end of the insulating ring, and at least part of the fuse is disposed inside the insulating ring.

In some embodiments of the present disclosure, the fuse is isolated from the inner circumferential surface of the insulating ring by a preset distance.

In some embodiments of the present disclosure, the insulating ring is a ceramic ring.

In some embodiments of the present disclosure, the insulating ring is filled with quartz sand.

In some embodiments of the present disclosure, the insulating ring has a metal layer respectively on the upper end surface and the lower end surface.

In some embodiments of the present disclosure, the fuse has a cylinder body, and each of the edges of the upper end and the lower end of the fuse has an outwardly extending flange, and the flange extends to the corresponding end surface of the insulating ring.

In some embodiments of the present disclosure, the body of the fuse is located in the insulating ring, and an annular cavity surrounding the fuse is defined between the body part of the fuse and the inner circumferential surface of the insulating ring.

In some embodiments of the present disclosure, the fuse has a fusing part located in the middle position of the body part in the axial direction.

In some embodiments of the present disclosure, the upper terminal is respectively soldered to the fuse and the insulating ring, and the lower contacts are respectively soldered to the fuse and the insulating ring.

In some embodiments of the present disclosure, a first connecting ring is provided on the lower surface of the upper terminal, and the first connecting ring is respectively soldered to the upper end surface of the insulating ring and the upper end surface of the fuse, while a second connecting ring is disposed on the upper surface of the lower contact, and the second connecting ring is respectively soldered to the lower end surface of the insulating ring and the lower end of the fuse.

In some embodiments of the present disclosure, the axes of the first connecting ring and the second connecting ring extend in the up and down direction, and the wall thickness of the first connecting ring and the second connecting ring is in a range of 1 mm to 5 mm.

In some embodiments of the present invention, the relay further comprises a magnet disposed circumferentially.

In some embodiments of the present invention, the housing comprises: a ceramic casing, the bottom of which is open; a pallet which is disposed under the ceramic casing so as to enclose the bottom of the ceramic casing; and a connecting platform which is respectively connected to the ceramic casing and the pallet.

In some embodiments of the present invention, the housing is filled with hydrogen or helium.

In some embodiments of the present invention, the driving device comprises: a push rod, the upper end of the push rod being connected to the base plate and lower end projecting downwardly from the housing, the upper end of the push rod passing through the base plate and being connected to a snap spring and a gasket, wherein the snap spring is clamped on the push rod, and the gasket is positioned between the snap spring and the connecting part; and a buffer spring, the buffer spring being sleeved outside the push rod, wherein the upper end of the buffer spring presses against the base plate, and the lower end of the buffer spring presses against the push rod or the bottom of the housing.

Furthermore, the circumferential sheath of the upper end of the push rod is provided with an insulating sheath which isolates the push rod from the base plate, and the upper end of the buffer spring presses against the insulating sheath.

REFERENCE NUMBERS

Figure 1:
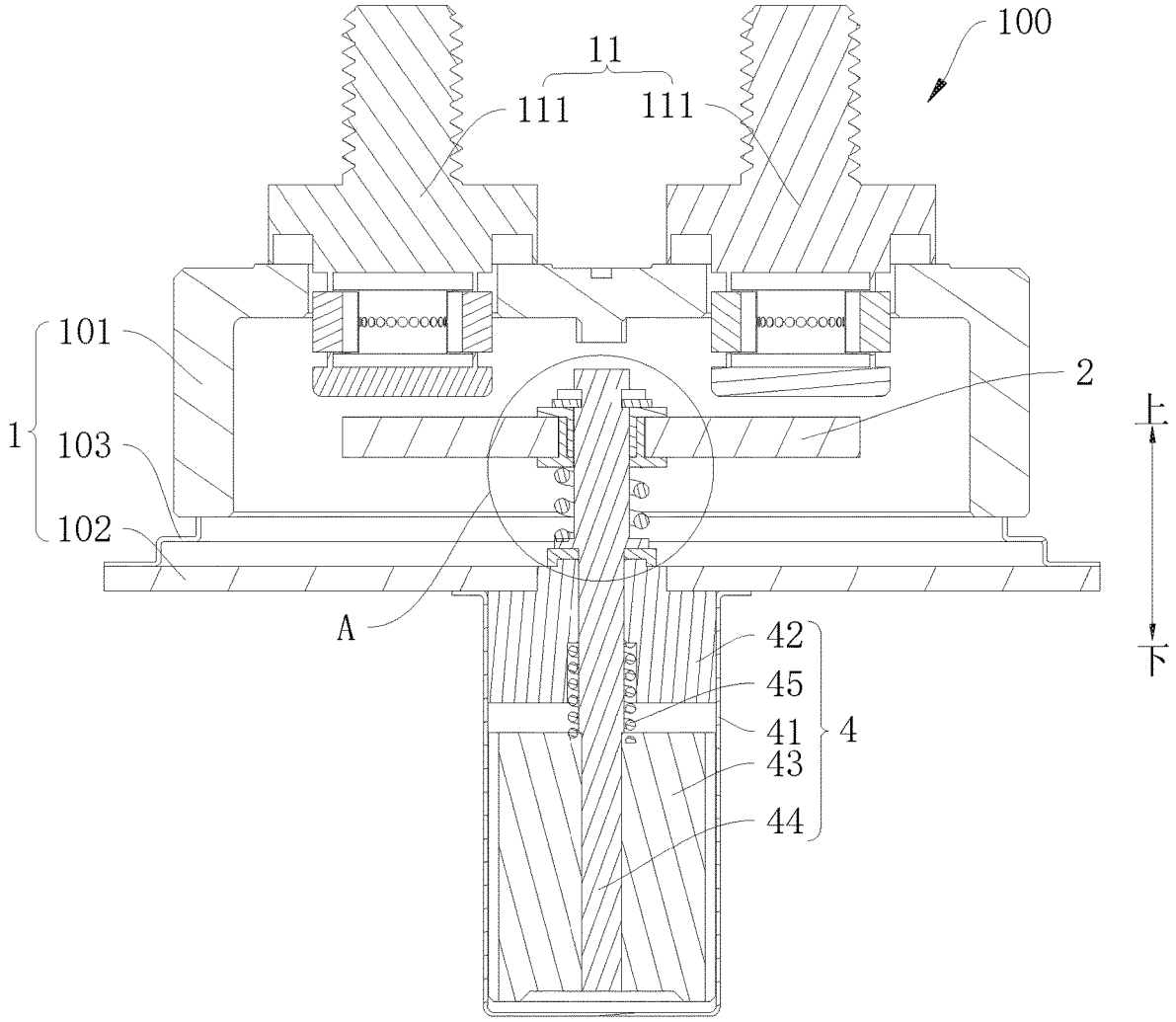
FIG. 1 is a cross-sectional view of a relay in an embodiment of the present disclosure.

Relay 100 housing 1, stationary contact group 11, stationary contact 111, upper terminal 1111, lower contact 1112, insulating ring 1113, annular cavity 1114, first connecting ring 1115, second connecting ring 1116, ceramic casing 101, pallet 102, connecting platform 103, base plate 2, fuse 3, flange 31, fusing part 32, body part 33, driving device 4, sleeve 41, limiting post 42, iron core 43, push rod 44, reset spring 45, sheath 46, buffer spring 47, snap spring 48, gasket 49, upper insulating cover 461, lower insulating cover 462.

DETAILED DESCRIPTION

The embodiments of the present disclosure are described in detail below, and the examples of the embodiments are illustrated in the accompany drawings, wherein, the same or similar reference numbers always refer to the same or similar elements, or an element having the same or similar functions. The following embodiments described with reference to the accompany drawings are illustrative, aim to explain the present disclosure, and are not to be construed as limitation to the present disclosure.

In the following, the relay 100 in an embodiment of the present disclosure is described in detail with reference to the accompany drawings.

In conjunction with FIGS. 1 to 6, the relay 100 in an embodiment of the present disclosure, comprising: a housing 1, a base plate 2, and a driving device 4.

The housing 1 is provided with at least one stationary contact group 11; the stationary contact group 11 includes two mutually insulated stationary contacts 111; and at least one stationary contact 111 in the stationary contact group 11 includes an upper terminal 1111 and a lower contact 1112. The upper terminal 1111 and the lower contact 1112 are isolated from each other for insulation, and the upper terminal 1111 and the lower contact 1112 are connected together by a fuse 3, thus electrical conduction between the upper terminal 1111 and the lower contact 1112 is realized by the fuse 3. That is, the upper terminal 1111 and the lower contact 1112 are insulated from each other when the fuse 3 is not connected, and then the upper terminal 1111 and the lower contact 1112 are electrically connected by the fuse 3.

The base plate 2 is disposed in the housing 1, and can switch between an on position and an off position. When the base plate 2 is in the on position, the base plate 2 is in contact with the two stationary contacts 111 in the stationary contact group 11 for electrical conduction of the two stationary contacts 111 in the stationary contact group 11. As shown in FIG. 1, when the base plate 2 is in the off position, the base plate 2 is isolated from the two stationary contacts 111 in the stationary contact group 11 so as to disconnect the electrical conduction of the two stationary contacts 111 in the stationary contact group 11.

The driving device 4 is connected to the base plate 2 so as to drive the base plate 2 to switch between the on position and the off position.

During the use of the relay 100, if a problem such as current overload or short circuit occurs, the fuse 3 in the stationary contact 111 is disconnected, thereby disconnecting the electrical connection among the plurality of the stationary contacts 111, and causing the relay 100 be in an off state. Consequently, the circuit is disconnected.

According to the relay 100 in the embodiment of the present disclosure, due to the fuse 3 disposed in the stationary contact 111, the effects of overload protection and short circuit protection are realized by the fuse 3, so as to improve the safety of a circuit system having the relay 100, and avoid fire disaster or the like caused by the over current or short circuit.

In the present disclosure, the fuse 3 is used for overload protection, effectively avoiding a risk caused by the current overload or short circuit.

In the present disclosure, the fuse 3 is integrated into the stationary contact 111 to facilitate replacement of the fuse 3 and maintenance of the relay 100, as well as the use and maintenance of the relay 100 and the circuit system having the relay 100.

Further, the base plate 2 of the present disclosure may further be provided with at least one movable contact group corresponding to the stationary contact group 11, and each movable contact group includes two electrically conducted movable contacts. When the base plate 2 is in the on position, the movable contact group 21 is in contact with the stationary contact group 11, and the two stationary contacts 111 in the stationary contact group 11 are electrically conducted. When the base plate 2 is in the off position, the movable contact group is isolated from the stationary contact group 11, and two stationary contacts 111 in the stationary contact group 11 disconnect the electrical conduction.

At least one stationary contact group may be disposed on the housing 1 in the present disclosure. The at least one stationary contact 111 in the at least one stationary contact group 11 includes the upper terminal 1111 and the lower contact 1112, and the upper terminal 1111 and the lower contact 1112 are conducted by the fuse. For example, the number of the stationary contact group 11 is one, and one of the two stationary contacts 111 in the stationary contact group 11 includes the upper terminal 1111 and the lower contact 1112, or, each of the stationary contacts 111 in the stationary contact group 11 includes the upper terminal 1111 and the lower contact 1112. As another example, the number of the stationary contact group 11 is two, and one or each of the stationary contacts 111 in one stationary contact group 11 includes the upper terminal 1111 and the lower contact 1112, while two stationary contacts 111 in the other stationary contact group 11 do not include the upper terminal 1111 and the lower contact 1112. As another example, the number of the stationary contact group 11 is two, and each of the stationary contacts 111 in each of the two stationary contact group 11 includes the upper terminal 1111 and the lower contact 1112.

Certainly, the number of the stationary contact group 11 is not limited in the present disclosure. For example, the number of the stationary contact group 11 may be three, four, or any other number.

In a specific example of the present disclosure, both of the upper terminal 1111 and the lower contact 1112 may be connected to the housing 1 so that the upper terminal 1111 and the lower contact 1112 are fixed relative to each other, and the upper terminal 1111 is isolated from the lower contact 1112 for mutual insulation. The upper terminal 1111 and the lower contact 1112 are electrically connected by the fuse 3. A cavity may also be defined between the upper terminal 1111 and the lower contact 1112 by means of the housing 1. A connection structure may also be provided between the upper terminal 1111 and the lower contact 1112, so that the upper terminal 1111 and the lower contact 1112 are fixed relative to each other, and the upper terminal 1111 is isolated from the lower contact 1112 for the insulation. The upper terminal 1111 is electrically connected to the lower contact 1112 by the fuse 3. In the present disclosure, it is only necessary that the mutual insulation exists when the fuse 3 is not connected between the upper terminal 1111 and the lower contact 1112, and the electrical connection may be realized by the fuse 3. Connection structures in some specific embodiments are described with reference to the accompany drawings.

Figure 3:
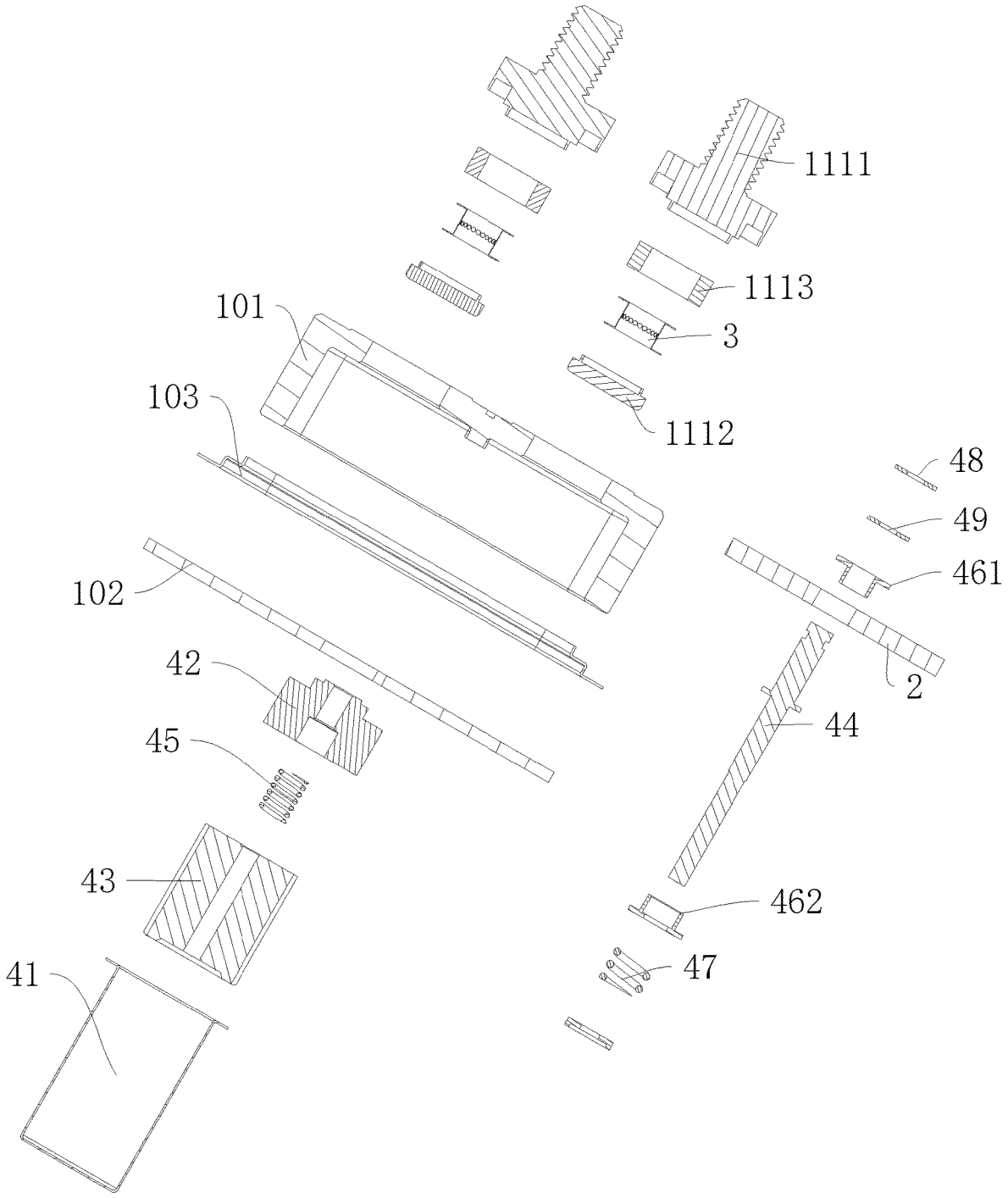
FIG. 3 is a schematic exploded view of the relay shown in FIG. 1.
Figure 4:
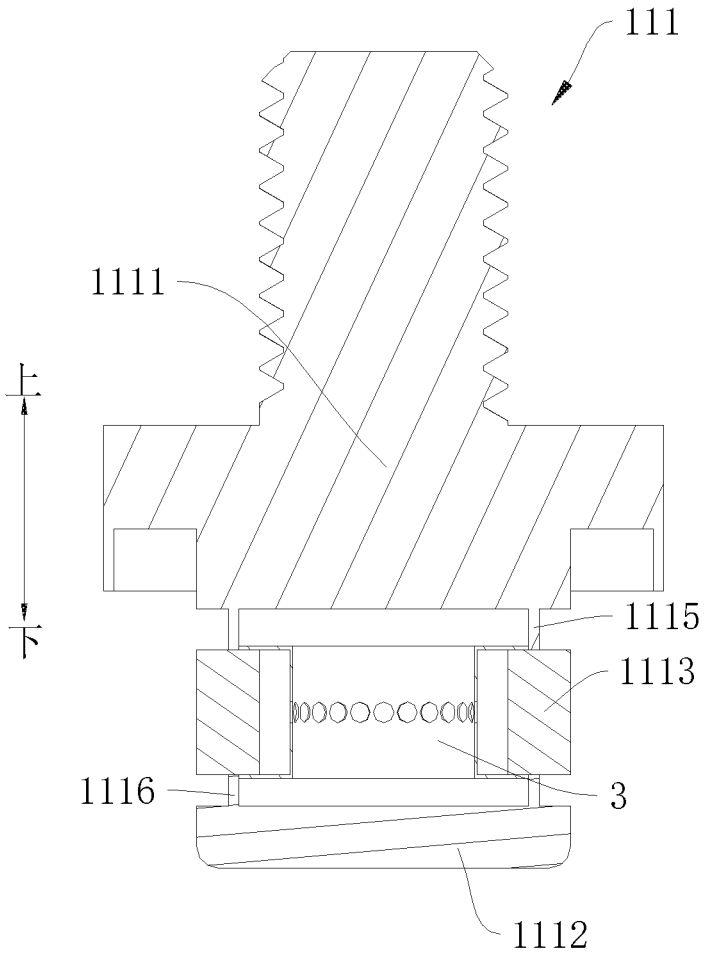
FIG. 4 is a cross-sectional view of a stationary contact of a relay in one embodiment of the present disclosure.

As shown in FIGS. 3 and 4, in some embodiments of the present disclosure, an insulating ring 1113 is connected between the upper terminal 1111 and the lower contact 1112. The upper terminal 1111 encloses the upper end of the insulating ring 1113, and the lower contact 1112 encloses the lower end of the insulating ring 1113. Both ends are enclosed by the upper terminal 1111 and the lower contact 1112, so as to define an enclosed cavity in the insulating ring 1113. At least part of the fuse 3 is provided inside the insulating ring 1113. That is, the fuse 3 is accommodated by the insulating ring 1113, thereby forming a protection effect to the fuse 3. Moreover, when the fuse 3 is in fusing, the fuse 3 in the fusing is prevented from being scattered to cause the safety hazard, thus improving the safety performance of the relay 100.

In order to facilitate a smooth disconnection when the fuse is in fusing, in the present disclosure, the fuse 3 is isolated from the inner circumferential surface of the insulating ring 1113 by a preset distance, so as to avoid the fusing difficulty of the fuse 3 due to the bonding of the fuse 3 to the inner circumferential surface of the insulating ring 1113. Alternatively, the fuse 3 has a fusing part 32 isolated from the inner circumferential surface of the insulating ring 1113.

As ceramic has the advantages of structural stability and good insulating performance etc., in the present disclosure, a ceramic material is used to make the insulating ring 1113. In other words, the insulating ring 1113 is a ceramic ring. Certainly, other materials such as plastic or the like may also be used to make the insulating ring 1113.

Further, in order to further enhance arc extinguishing effect of the relay 100, in the present disclosure, the insulating ring 1113 is filled with quartz sand (not shown). With the arc extinguishing by the quartz sand, the safety hazard caused by generating arc is avoided and the impact on product safety due to long arcing time when the fuse 3 is in fusing is reduced.

In some embodiments of the present disclosure, in order to facilitate the electrical connection between the fuse 3 and the upper terminal 1111 and the lower contact 1112, a metal layer is provided on both the upper end surface and the lower end surface of the insulating ring 1113.

Due to the metal layer disposed on the upper end surface and the lower end surface of the insulating ring 1113, the upper and lower ends of the fuse 3 may be soldered to the corresponding metal layer so as to realize the installation of the fuse 3, resulting in convenient installation and high structural strength of the fuse 3. Moreover, the conduction effect between the upper terminal 1111 and the fuse 3 and the conduction effect between the lower contact 1112 and the fuse 3 may also be enhanced by the metal layer.

Further, in conjunction with FIGS. 4, 5, 6, and 7, the fuse 3 has a cylindrical body part 33, and each of the edges of the upper and lower ends of the fuse 3 has an outwardly extending flange 31, and the flange 31 extends to the corresponding end surface of the insulating ring 1113. That is, both ends of the fuse 3 are connected to the end surfaces of the insulating ring 1113, and the middle part of the fuse 3 is in the insulating ring 1113. During assembling, because both ends of the fuse 3 are disposed on the end surfaces of the insulating ring 1113, the fuse 3 is easy to be electrically connected when the upper terminal 1111 is at the upper end of the enclosed insulating ring 1113, while the fuse 3 is easy to be electrically connected when the lower contact 1112 is at the lower end of the enclosed insulating ring 1113, thus improving the installation efficiency of the relay 100. Moreover, the upper terminal 1111 and the lower contact 1112 may keep electrical connection with the fuse 3.

Figure 5:
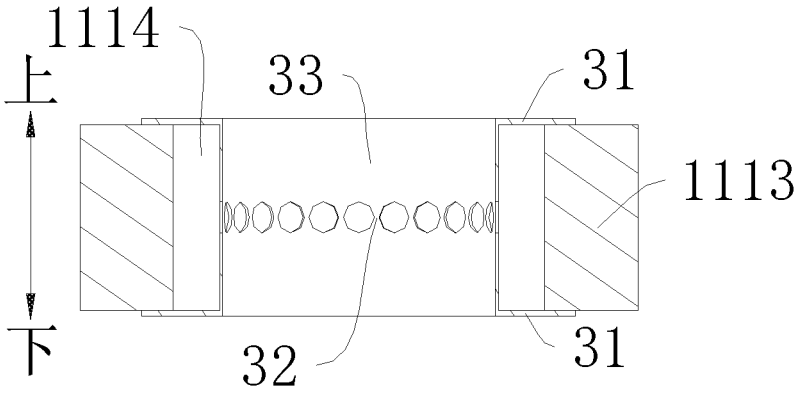
FIG. 5 is a schematic matching view of a fuse and an insulating ring of a relay in one embodiment of the present disclosure.
Figure 6:
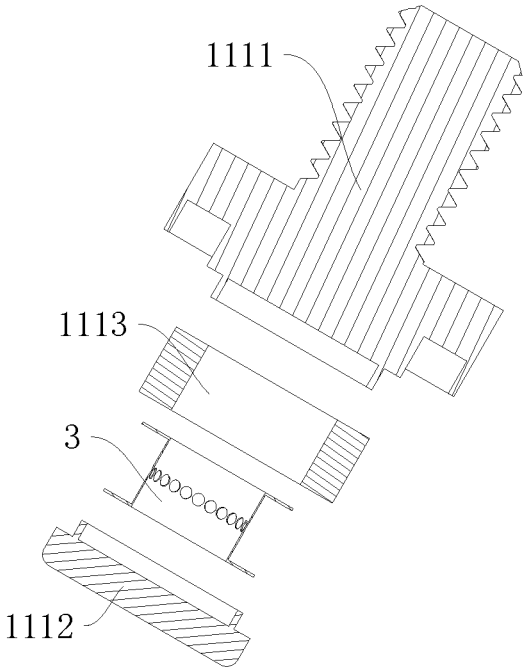
FIG. 6 is a schematic exploded view of a short circuit protection structure in one embodiment of the present disclosure.

Further, as shown in FIG. 5 and in conjunction with FIG. 6, the body part 33 of the fuse 3 is disposed in the insulating ring 1113, and the body part 33 of the fuse 3 and the inner circumferential surface of the insulating ring 1113 are apart from each other, and a annular cavity 1114 is defined between the body part 33 of the fuse 3 and the inner circumferential surface of the insulating ring 1113, wherein the annular cavity 1114 surrounds the body part 33 of the fuse 3. Therefore, the efficient isolation of the body part 33 of the fuse 3 from the insulating ring 1113 is realized by the annular cavity 1114, so that the fuse 3 may be in fusing smoothly.

Figure 7:
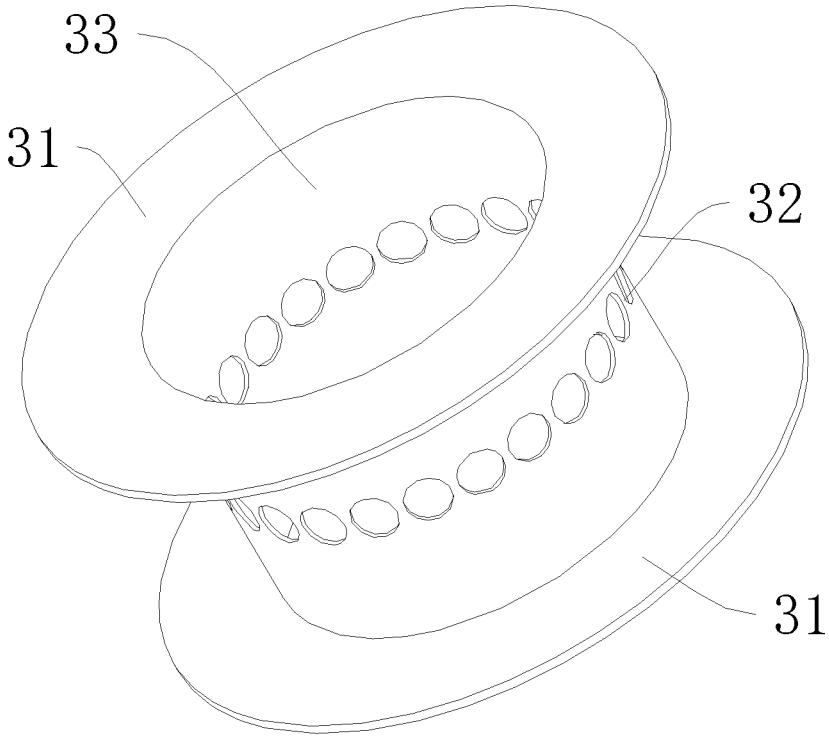
FIG. 7 is a schematic view of a fuse in one embodiment of the present disclosure.

As shown in FIG. 5 and in conjunction with FIG. 7, the fusing part 32 of the fuse is in the middle position of the body part 33 of the fuse 3 in the axial direction (see the up and down direction in FIG. 5) to further facilitate the fusing of the fuse.

Alternatively, the fuse 3 is soldered to the insulating ring 1113, so as to stably install the fusion 3 on the insulating ring 1113 by means of soldering, thus improving the stability and safety of the relay 100. Moreover, as the fuse 3 is fixed, the upper terminal 1111 and the lower contact 1112 may be installed conveniently, thus improving the assembly efficiency of the relay 100.

Further, the upper terminal 1111 are soldered respectively to the fuse 3 and the insulating ring 1113, and the lower contact 1112 is soldered respectively to the fuse 3 and the insulating ring 1113.

Preferably, in order to improve the soldering effect of each part, as shown in FIG. 4, the lower surface of the upper terminal 1111 in the present disclosure is provided with a first connecting ring 1115, and the first connecting ring 1115 is respectively soldered to the upper end surface of the insulating ring 1113 and the upper end of the fuse 3. The upper surface of the lower contact 1112 is provided with a second connecting ring 1116, and the second connecting ring 1116 is respectively soldered to the lower end surface of the insulating ring 1113 and the lower end of the fuse 3. The uniformity of the solder at a weld is improved, thus enhancing the stability of the weld.

With reference to FIG. 4, the axes of the first connecting ring 1115 and the second connecting ring 1116 extend in the up and down direction, and the wall thickness of the second connecting ring 1116 and the first connecting ring 1115 is in the range of 1 mm to 5 mm.

In some embodiments of the present disclosure, the relay 100 further comprises a magnet (not shown) disposed in a circumferential direction. Under the action of the magnetic field of the magnet, the arc is elongated, and the arc is divided into segments by arc chute at this time, thereby having the effect of arc extinguishing by means of the magnet.

In conjunction with the FIG. 1 and FIG. 3, in some embodiments of the present disclosure, the housing 1 comprises: a ceramic casing 101, a pallet 102, and a connecting platform 103, wherein the bottom of the ceramic casing 101 is open, and the pallet 102 is disposed under the ceramic casing 101 so as to enclose the bottom of the ceramic casing 101, and the connecting platform 103 is respectively connected to the ceramic casing 101 and the pallet 102. By the matching of the ceramic casing 101 and the pallet 102, a sealed cavity may be formed in the ceramic casing 101, so as to avoid the dust and the like from entering the housing 1, and the electrical safety may be improved at the same time. Moreover, the housing 1 is divided into the ceramic casing 101, the pallet 102 and the connecting platform 103, which facilitates the installation of elements such as the base plate 2, and the driving device 4.

The ceramic has relatively good strength, high chemical stability and thermal stability, and is also a poor electrical conductor. Therefore, in the present disclosure, the ceramic casing is utilized. The insulation performance of the housing 1 is improved to reduce the safety hazard.

Certainly, in other embodiments of the present disclosure, the housing 1 may be other insulating materials. In the present disclosure, the specific material of the housing 1 is not limited. In practice, the material may be adaptively selected.

Further, the housing 1 is filled with hydrogen or helium. With the hydrogen or helium, an arc extinguishing gas layer may be formed, and during a switching procedure of the relay 100, the arc is quickly extinguished by the hydrogen or helium, thereby reducing the safety hazard.

In a closed space full of the hydrogen or nitrogen, when the fuse 3 normally operates and generates the arc, under the cooling action of the gas (the hydrogen or nitrogen), the arc can be quickly extinguished, thus the safety of the use of the relay 100 may be further improved.

Figure 2:
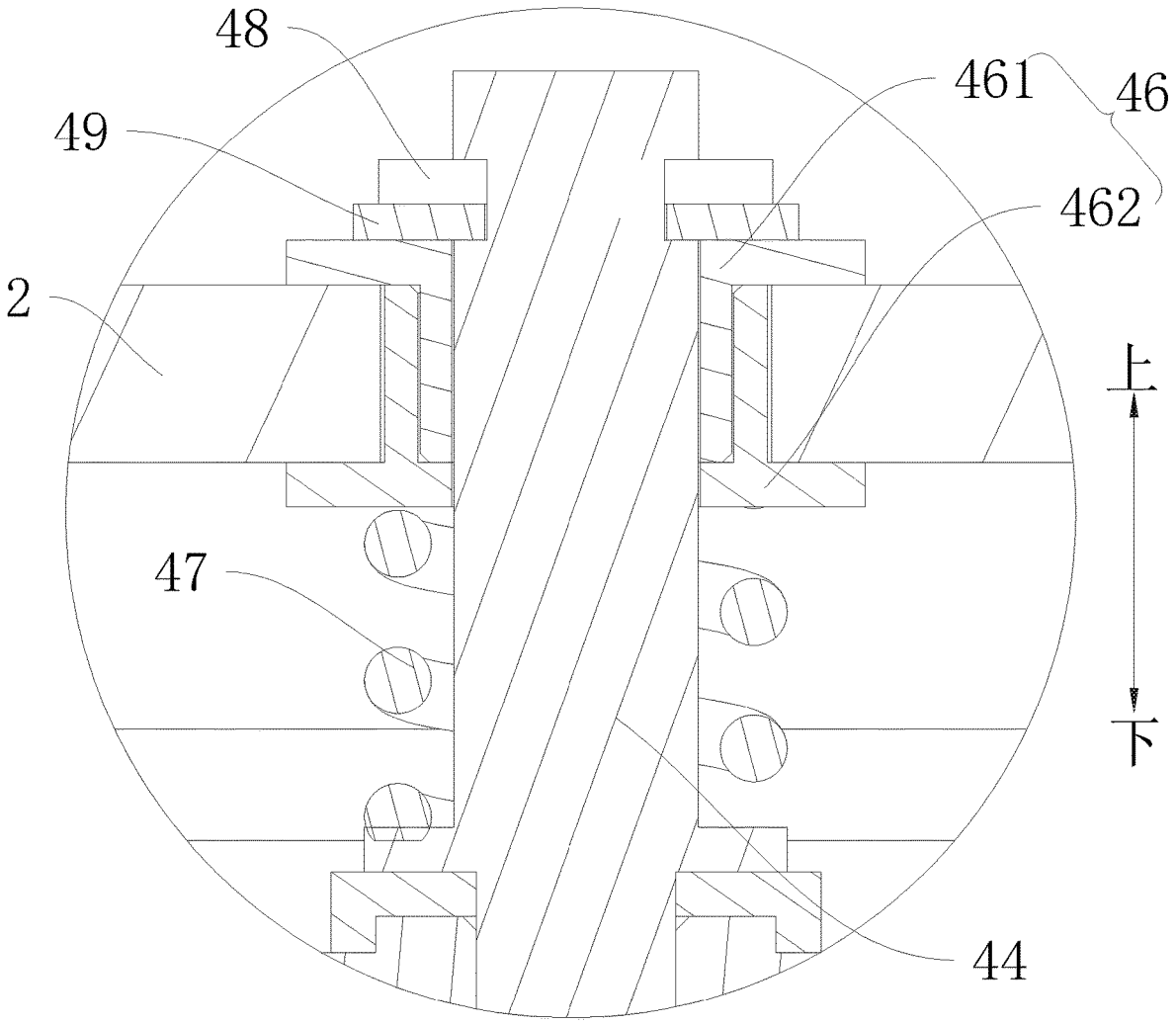
FIG. 2 is an enlarged schematic view of the area shown by the circle A in FIG. 1.

In some embodiments of the present disclosure, in conjunction with FIGS. 1, 2 and 3, the driving device 4 is connected to the bottom of the housing 1, and the driving device 4 comprises a push rod 44 and a buffer spring 47. The upper end of the push rod 44 is connected to the base plate 2 and the lower end projects downwardly from the housing 1. The upper end of the push rod 44 passes through the base plate 2 and is connected to a snap spring 48 and a gasket 49. The snap spring 48 is clamped on the push rod 44 and the gasket 49 is between the snap spring 48 and the connection part 202. The buffer spring 47 is sleeved outside of the push rod 44 and the upper end of the buffer spring 47 presses against the base plate 2, while the lower end of the buffer spring 47 presses against the push rod 44 or the bottom of the housing 1. With the matching of the buffer spring 47 and the snap spring 48, etc., the buffering of the base plate 2 is realized. During the on and off process of the relay, rigid contact between the stationary contact group 11 and the movable contact group 21 may be avoided by buffering, thereby improving the stability of the relay and reducing the noise of the relay.

In conjunction with FIGS. 1 and 2, the base plate 2 is provided with a sheath 46. The sheath 46 may be used to isolate the base plate 2 from the push rod 44, thereby avoiding damage and breakdown of elements at the low voltage side. Therefore, the quality of the relay 100 and the safety of the use are improved.

Further, in conjunction with FIGS. 1 and 2, the insulating sheath 46 is sleeved on the peripheral of the upper end of the push rod 44 so as to isolate the push rod 44 from the base plate 2, and the upper end of the buffer spring 47 presses against the insulating sheath 46, thereby electrically isolating the buffer spring 47 from the base plate 2.

Further, as shown in FIG. 2, the base plate 2 is provided with a through hole, and the insulating sheath 46 may be disposed inside the through hole, and the insulating sheath 46 may be sleeved outside the push rod 44. Therefore, the push rod 44 may be protected to a certain extent, so the accuracy and smoothness of the action of the push rod 44 may be ensured, thereby improving the performance of the use of the relay 100.

Further, as shown in FIG. 1, the driving device 4 further comprises a sleeve 41, a limiting post 42, an iron core 43 and a reset spring 45.

The upper end of the sleeve 41 is connected to the housing 1, and the limiting post 42 is disposed on the upper part of the sleeve 41 and is connected to the housing 1; the iron core 43 is disposed on the lower part of the sleeve 41 and is able to move up and down; one end of the push rod 44 is connected to the iron core 43 and the other end is connected to the base plate 2; and the reset spring 45 is sleeved outside the push rod 44 and both ends respectively press against the iron core 43 and the limiting post 42. Therefore, the on and off of the relay 100 is easily controlled by the driving device 44, thus the performance of the use of the relay 100 may be improved to a certain extent.

In the example of FIG. 1, the lower end of the reset spring 45 presses against the iron core 43, and the upper end of the reset spring 45 presses against the limiting post 42. Therefore, under the action of the reset spring 45, the operation of the driving device 4 is made smoother and the on and off of the relay 100 is easy to be controlled.

As shown in FIGS. 1 to 3, in some embodiments of the present disclosure, the upper end of the push rod 44 (for example, the upper end of the push rod 44 in FIG. 1 or 2) may pass through the through hole in the base plate 2. The end of the push rod 44 passing through the through hole is provided with the snap spring 48 and gasket 49. The gasket 49 can reduce the force of the snap spring 48 and may prevent the snap spring 48 from falling off. In this way, the operational stability of the relay 100 may be further improved. The buffer spring 47 is sleeved outside of the push rod 44 (for example, the side distanced from the push rod 44 in FIGS. 1 and 2), and the buffer spring 47 may be used to constantly push the push rod 44 so that the base plate 2 presses against the snap spring 48. Therefore, the action of the push rod 44 may be smoother, and the action accuracy of the relay 100 may also be improved.

One end of the buffer spring 47 is connected to the base plate 2, and the other end of the buffer spring 47 is connected to one of the push rod 44 and the housing.

That is, in conjunction with FIGS. 1 and 2, a first end of the buffer spring 47 is connected to the base plate 2 (for example, the upper end of the buffer spring 47 in FIG. 2), and a second end of the buffer spring 47 (for example, the lower end of the buffer spring 47 in FIG. 1) is connected to the base plate 2; alternatively, the first end of the buffer spring 47 is connected to the base plate 2 (for example, the upper end of the buffer spring 47 in FIG. 2), and the second end of the buffer spring 47 (for example, the lower end of the buffer spring 47 in FIG. 1) is connected to the housing 1. Certainly, it is also possible that the upper end of the buffer spring 47 is connected to the housing 1 and the lower end is connected to the base plate 2. At this time, the buffer spring should often be in a stretched state. The operation smoothness of the relay 100 may be enhanced, which satisfies the requirements of the user better.

In addition, with reference to FIG. 2, the insulating sheath 46 in the present disclosure comprises an upper insulating cover 461 and a lower insulating cover 462. The upper insulating cover 461 comprises a first cylindrical body and a first flange at the upper end of the first cylindrical body, and the lower insulating cover 462 comprises a second cylindrical body and a second flange at the lower end of the second cylindrical body. The first cylindrical body of the upper insulating cover is inserted into the through hole, and the first flange presses against the upper surface of the base plate, while the second cylindrical body of the lower insulating cover is inserted into the through hole, and the second flange presses against the lower surface of the base plate. The first cylindrical body is inserted into the second cylindrical body, and the first cylindrical body and the second cylindrical body are inserted into the through hole together.

As shown in FIG. 1 to FIG. 6, the relay 100 according to the embodiment of the present disclosure has over current protection function of the circuit, and can realize the function of the circuit breaker. Short circuit protection structure consists of the upper terminal 1111, the ceramic ring (i.e., the insulating ring 1113), the fuse 3, and the lower contact 1112. The short circuit protection structure may be assembled as follows: metalizing the upper and lower surfaces of the ceramic ring; brazing the fuse 3 and the ceramic ring after the fuse 3 is folded into two; and then brazing the ceramic ring and the lower contact 1112; and filling the quartz sand into the ceramic ring. That is, the lower contact 1112, the ceramic ring and the upper terminal 1111 constitute the stationary contact 111 having the fuse 3 as shown in FIG. 4. The fuse 3 has function of the overload protection, and the quartz sand has function of the arc extinguishing when the fuse 3 is in fusing, and the ceramic ring has the functions of supporting, fixing, preventing splashing when the fuse 3 is in fusing, and insulation of the upper and lower contacts 1112 after the fuse 3 is in fusing.

When assembling the relay 100 according to the embodiment of the present disclosure, firstly, the fuse 3 is soldered to the ceramic ring; secondly, the lower contact 1112 of the upper terminal 1111 is soldered to the ceramic ring to form the stationary contact 111; and then the stationary contact 111 is soldered to the ceramic casing 101 so as to form two sets of safety mechanisms; the buffer spring, lower insulating cover, base plate, upper insulating cover are assembled on the push rod in turn; and the gasket is assembled at last, and then snap spring is used for fixing.

After assembling the above components, the driving device 4 is installed. The pallet 102, limiting post 42, reset spring 45 are installed on the push rod in turn, and the iron core 43 and the push rod are fixed by means of laser soldering or screwing. As shown in FIG. 1, the relay is in the off state. When the driving device 4 starts working, the base plate contacts the stationary contact 111 having the fuse 3, and load current pass through the fuse 3. When the load current is too high or the short circuit happens to the circuit, the fuse is in fusing so as to have the protection effect. With combined action of the external magnet of the relay 100, hydrogen in the cavity and the quartz sand in the ceramic ring, the arc can be extinguished quickly. Two sets of the safety stationary contacts 111 act at the same time, so the protection effect is gained more safely. In the on state, the upper insulating cover and the lower insulating cover isolate the push rod from the high voltage load end, thereby insulating the high and low voltage, and preventing the damage to the elements at the low voltage end and the breakdown phenomenon. Thus, the quality of the product and the safety are improved.

In the present disclosure, the fuse 3 is used for the overload protection, which effectively prevents the risks caused by the current overload or short circuit. Meanwhile, with the combined action of the external magnet of the relay 100, the hydrogen in the cavity and the quartz sand in the ceramic ring, the impacts to the product safety caused by the long arcing time are reduced when the fuse 3 is in fusing. The two sets of the safety stationary contacts 111 act at the same time. Thus, the fusing accuracy of the product and the safety of the use are improved. In contrast, in the present disclosure, the fuse 3 and the relay 100 are combined, which saves the whole overall use space and cost. It can effectively improve the quality and safety of the product by using the arc extinguishing mechanism of the relay 100 on the fuse 3.

In the description of the present disclosure, it should be understood that orientation or position relationships indicated by the terms "central", "longitudinal", "transverse", "length", "width", "thickness", "on", "under", "front", "rear", "left", "right", "vertical", "horizontal", "top", "bottom", "inside", "outside", "clockwise", "counterclockwise", "axial direction", "radial", "circumferential", and the like are orientation or position relationships based on what is shown in the accompanying drawings, and are only used to facilitate description of the present invention and simplify the description, rather than to indicate or imply that the device or component must be in specific orientation or disposed and operated in the specific orientation, and therefore cannot be understood as a limitation to the present invention.

In addition, the terms "first" and "second" are only used for description purpose and cannot be understood to indicate or imply relative importance or implicitly indicate the quantity of technical features. Therefore, features that are defined by "first" and "second" may explicitly or implicitly include one or more features. In the description of the present disclosure, the meaning of "a plurality of" is two or more, for example, two, three and the like, unless otherwise clearly and specifically limited.

In the present disclosure, unless clearly specified or limited, the terms "mounted," "connected," "coupled", "fixed" and the like are construed broadly and encompass such as fixed or detachable or integral connections, mechanical or electrical connections, can also be direct connections and indirect connections by using an intermediate medium, and can also be inner connections of two components or mutual effect relationships of two components. The specific meanings of the foregoing terms in the present disclosure can be understood by those skilled in the art according to the specific cases.

In the present disclosure, unless clearly specified or limited otherwise, when a first feature is "on" or "under" a second feature, the first and second features may be in direct contact, or the first and second features are in indirect contact by using an intermediate medium. Moreover, when the first feature is "on" or "above" the second feature, the first feature may be right above the second feature or obliquely above the second feature, or it merely represents that the first feature is horizontally higher than the second feature. When the first feature is "under" or "below" the second feature, the first feature may be right below the second feature or obliquely below the second feature, or it merely represents that the first feature is horizontally lower than second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in an embodiment," "in some embodiments", "in an example," "in a specific example," or "in some examples," in various places throughout this specification are not necessarily referring to the same embodiment or example of the present invention. Moreover, the particular features, structures, materials, or characteristics may be combined in a suitable manner in any one or more embodiments or examples. In addition, various embodiments or examples described in the specification, as well as features of various embodiments or examples, may be combined in the case of non-contradiction.

Although embodiments of the present disclosure have been shown and described above, it would be appreciated that the above embodiments are exemplary and cannot be construed to limit the present invention, and changes, modifications, replacements, and alternatives can be made to the above embodiments by those skilled in the art without departing from the scope of the present invention.

What is claimed is:

1. A relay, comprising:

a housing, on which at least one stationary contact group is provided, wherein the stationary contact group includes two stationary contacts insulated from each other, at least one stationary contact in the stationary contact group includes an upper terminal and a lower contact are included, and the upper terminal and the lower contact are isolated from each other and electrically connected by a fuse;

a base plate, which is provided in the housing and can switch between an on position and an off position, wherein the base plate, when being in the on position, contacts the stationary contact group for the electrical conduction of the two stationary contacts in the stationary contact group, and the base plate, when being in the off position, is isolated from the stationary contact group for disconnecting the electrical conduction of the two stationary contacts in the stationary contact group; and a driving device, connected to the base plate so as to drive the base plate to switch between the on position and the off position.

2. A The relay according to claim 1, wherein an insulating ring is connected between the upper terminal and the lower contact, wherein the upper terminal encloses the upper end of the insulating ring and the lower contact encloses the lower end of the insulating ring, and at least part of the fuse is disposed inside the insulating ring.

3. The relay according to claim 2, wherein the fuse is isolated from the inner circumferential surface of the insulating ring by a preset distance.

4. The relay according to claim 2, wherein the insulating ring is a ceramic ring.

5. The relay according to claim 2, wherein the insulating ring is filled with quartz sand.

6. The relay according to claim 2, wherein the insulating ring has a metal layer respectively on the upper end surface and the lower end surface.

7. The relay according to claim 6, wherein the fuse has a cylinder body, and each of the edges of the upper end and the lower end of the fuse has an outwardly extending flange, and the flange extends to the corresponding end surface of the insulating ring.

8. The relay according to claim 7, wherein the body of the fuse is located in the insulating ring, and an annular cavity surrounding the fuse is defined between the body part of the fuse and the inner circumferential surface of the insulating ring.

9. The relay according to claim 8, wherein the fuse has a fusing part, the fusing part located in the middle position of the body part in the axial direction.

10. The relay according to claim 2, wherein the upper terminal is respectively soldered to the fuse and the insulating ring, and the lower contact is respectively soldered to the fuse and the insulating ring.

11. The relay according to claim 10, wherein a first connecting ring is provided on the lower surface of the upper terminal, and the first connecting ring is respectively soldered to the upper end surface of the insulating ring and the upper end of the fuse, while a second connecting ring is disposed on the upper surface of the lower contact, and the second connecting ring is respectively soldered to the lower end surface of the insulating ring and the lower end of the fuse.

12. The relay according to claim 11, wherein the axes of the first connecting ring and the second connecting ring extend in the up and down direction, and the wall thickness of the first connecting ring and the second connecting ring is in a range of 1 mm to 5 mm.

13. The relay according to claim 1, wherein the relay further comprises a magnet disposed circumferentially.

14. The relay according to claim 1, wherein the housing comprises:

a ceramic casing, the bottom of which is open;

a pallet which is disposed under the ceramic casing so as to enclose the bottom of the ceramic casing; and a connecting platform which is respectively connected to the ceramic casing and the pallet.

15. The relay according to claim 1, wherein the housing is filled with hydrogen or nitrogen.

16. The relay according to claim 1, wherein the driving device comprises:

a push rod, the upper end of the push rod being connected to the base plate and lower end projecting downwardly from the housing, the upper end of the push rod passing through the base plate and being connected to a snap spring and a gasket, wherein the snap spring is clamped on the push rod, and the gasket is positioned below the snap spring; and a buffer spring, the buffer spring being sleeved outside the push rod, wherein the upper end of the buffer spring presses against the base plate, and the lower end of the buffer spring presses against the push rod or the bottom of the housing.

17. The relay according to claim 6, wherein the circumferential sheath of the upper end of the push rod is provided with an insulating sheath which isolates the push rod from the base plate, and the upper end of the buffer spring presses against the insulating sheath.

18. The relay according to claim 3, wherein the upper terminal is respectively soldered to the fuse and the insulating ring, and the lower contact is respectively soldered to the fuse and the insulating ring.

19. The relay according to claim 4, wherein the upper terminal is respectively soldered to the fuse and the insulating ring, and the lower contact is respectively soldered to the fuse and the insulating ring.

20. The relay according to claim 5, wherein the upper terminal is respectively soldered to the fuse and the insulating ring, and the lower contact is respectively soldered to the fuse and the insulating ring.

* * * * *